US009025797B2

(12) United States Patent
Akino

(10) Patent No.: US 9,025,797 B2
(45) Date of Patent: May 5, 2015

(54) RIBBON MICROPHONE AND UNIDIRECTIONAL CONVERTER THEREFOR

(71) Applicant: Hiroshi Akino, Tokyo (JP)

(72) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 14/289,865

(22) Filed: May 29, 2014

(65) Prior Publication Data

US 2014/0376752 A1 Dec. 25, 2014

(30) Foreign Application Priority Data

Jun. 20, 2013 (JP) ..... 2013-129540

(51) Int. Cl.
*H04R 25/00* (2006.01)
*H04R 1/08* (2006.01)
*H04R 17/02* (2006.01)

(52) U.S. Cl.
CPC ..... *H04R 1/08* (2013.01)

(58) Field of Classification Search
CPC ..... G10L 2021/02165; H04R 1/08; H04R 2410/05
USPC ..... 381/176, 356
See application file for complete search history.

(56) References Cited

U.S. PATENT DOCUMENTS

2011/0188680 A1* 8/2011 Akino ..... 381/176
2014/0003614 A1* 1/2014 Levitov et al. ..... 381/71.7

* cited by examiner

*Primary Examiner* — Ahmad F Matar
*Assistant Examiner* — Norman Yu
(74) *Attorney, Agent, or Firm* — Whitham, Curtis & Christofferson & Cook, P.C.

(57) ABSTRACT

A ribbon microphone includes a ribbon microphone unit; an acoustic box for mounting a rear acoustic terminal of the ribbon microphone unit; a detective microphone mounted in the acoustic box, the detective microphone detecting sound waves identical to sound waves guided to the rear acoustic terminal of the ribbon microphone unit; a speaker comprising a diaphragm, the speaker being assembled in the acoustic box and varying the pressure in the acoustic box in response to the driven diaphragm; and a drive unit for driving the speaker so as to cancel a variation in pressure in the acoustic box in response to signals detected by the detective microphone, the variation being caused by sound waves guided to the rear acoustic terminal. This configuration extracts an omnidirectional component without an acoustic tube to achieve a small high-sensitivity unidirectional ribbon microphone and a unidirectional converter for the ribbon microphone.

9 Claims, 7 Drawing Sheets

RIBBON MICROPHONE AND UNIDIRECTIONAL CONVERTER THEREFOR

TECHNICAL FIELD

The present invention relates to a ribbon microphone designed for providing unidirectivity and a unidirectional converter therefor.

BACKGROUND ART

A ribbon microphone includes main components, i.e., magnets generating a magnetic field and a ribbon diaphragm vibrating in the magnetic field in response to sound waves. The magnets are disposed on both sides of the ribbon diaphragm in the width direction and generates a magnetic field between the magnets on both sides. The magnets are supported by a frame composed of a magnetic material. The ribbon diaphragm with appropriate tension has both ends in the length direction fixed to the frame. The ribbon diaphragm vibrates in the magnetic field in response to sound waves to generate electrical signals in synchronization with the sound waves. Ribbon diaphragms are generally composed of an aluminum foil having high conductivity and low specific gravity. Ribbon microphones are disclosed in, for example, Japanese Unexamined Patent Application Publication Nos. 2009-200764 and 2011-160080.

A ribbon microphone outputs signals proportional to the particle velocity of sound waves, i.e., the velocity of air molecules moving in the anteroposterior directions due to sound pressure. This configuration readily provides a bidirectional microphone in general use. A unidirectional microphone is preferred in use for collection and amplification of musical sound because of its ease of use. A unidirectional ribbon microphone is therefore favorable for these uses.

An originally bidirectional ribbon microphone can be changed to unidirectivity by combining the omnidirectional component with the bidirectional component of the ribbon microphone. The omnidirectional component driving the diaphragm can be acquired by the sound pressure difference between an air chamber and the exterior that are separated with the diaphragm that blocks sound waves toward the air chamber. The rear surface of the diaphragm may therefore face the enclosed air chamber.

In order to combine the omnidirectional component with the bidirectional component, an acoustic resistance is disposed at the entrance of the small air chamber adjacent to the rear surface of the diaphragm, and the omnidirectional component is applied to then acquire a velocity component from a rear acoustic terminal. Sound waves entering from the rear acoustic terminal are divided by the acoustic mass of the rear acoustic terminal and the acoustic resistance at the entrance of the air chamber, and are guided to the rear of the diaphragm. The air chamber is necessary as the acoustic resistance. In a ribbon microphone, an acoustic tube is adjacent to the rear surface of a diaphragm and functions as the air chamber.

A ribbon diaphragm used for a ribbon microphone however has low mechanical impedance due to its small mass in comparison with a diaphragm of a dynamic microphone. As a result, a ribbon microphone needs an acoustic resistance operated effectively down to a low frequency region and therefore includes an acoustic tube filled with an acoustic resistance composed of, for example, cotton on the rear side of the diaphragm.

An example acoustic tube used for a ribbon microphone as mentioned above is described in Akio Mizoguchi, Acoustical Science and Technology, Vol. 18, No. 5, pp. 275-285. One end of the acoustic tube has a rectangular opening into which one end of the ribbon microphone unit can be attached. The size of the rectangular open end of the acoustic tube is matched with the size of the ribbon microphone having, for example, a width of 2 mm and a length of 20 mm. The acoustic tube has a diameter gradually decreasing from the opened end along the length and a cross section changing into a round shape, and is, for example, a considerably long tube having an inner diameter of about 7 mm. The acoustic tube is filled with an acoustic resistor composed of, for example, cotton. The rear end of the acoustic tube is closed while the rear space of the diaphragm is enclosed to provide an omnidirectional component. A part of the acoustic tube is provided with a hole. An opening or closing level of the hole can be adjusted with a shutter to adjust the directivity.

The typical size of the ribbon microphone is relatively small. Since a large area of the ribbon diaphragm is necessary for enhanced sensitivity, a ribbon microphone unit should also be large. A larger ribbon microphone unit however leads to a larger (wider and longer) acoustic tube. In order to attach the opened end of the acoustic tube to a microphone unit including a ribbon diaphragm having, for example, a width of 5 mm and a length of 50 mm, the opened end should have a size sufficient to cover the diaphragm. The other end of the acoustic tube should have an inner diameter of about 17.8 mm. Assuming that the entire length of the acoustic tube does not vary, the size of the ribbon diaphragm increases from 2 mm by 20 mm to 5 mm by 50 mm as described above to need a large acoustic tube having a volume of approximately 6.25 times that of the original tube.

A larger acoustic tube used for a unidirectional ribbon microphone leads to an increase in volume of the entire microphone and in length of the acoustic tube, which requires an appropriate design of the acoustic tube. In an example acoustic tube described in Akio Mizoguchi, Acoustical Science and Technology, Vol. 18, No. 5, pp. 275-285, a cylindrical member having a predetermined length is provided with multiple through-holes in parallel along its length, the ends of the through-holes being sequentially connected in series. The end of the acoustic tube provided by serial connection of the multiple through-holes is attached to one surface of the ribbon microphone unit.

As described above, a typical unidirectional ribbon microphone is provided with an acoustic tube. Use of an acoustic tube however increases the size of the entire ribbon microphone. A decrease in size leads to a small ribbon diaphragm, which cannot provide high sensitivity.

A small high-sensitivity unidirectional ribbon microphone could be achieved if an omnidirectional component could be extracted from the directional component of a ribbon microphone without an acoustic tube.

SUMMARY OF INVENTION

Technical Problem

It is an object of the present invention to extract an omnidirectional component without an acoustic tube to achieve a small high-sensitivity unidirectional ribbon microphone and a unidirectional converter for the ribbon microphone.

Solution to Problem

A ribbon microphone according to an aspect of the present invention includes:

a ribbon microphone unit;

an acoustic box for mounting a rear acoustic terminal of the ribbon microphone unit;

a detective microphone mounted in the acoustic box, the detective microphone detecting sound waves identical to sound waves guided to the rear acoustic terminal of the ribbon microphone unit;

a speaker comprising a diaphragm, the speaker being assembled in the acoustic box and varying the pressure in the acoustic box in response to the driven diaphragm; and a drive unit for driving the speaker so as to cancel a variation in pressure in the acoustic box in response to signals detected by the detective microphone, the variation being caused by sound waves guided to the rear acoustic terminal.

A unidirectional converter for a ribbon microphone according to another aspect of the present invention includes:

an acoustic box;

a baffle plate provided in the acoustic box;

a speaker mounted on the baffle plate;

a ribbon microphone unit attaching portion provided in the acoustic box;

an air chamber defined between the ribbon microphone unit attaching portion in the acoustic box and the baffle plate;

a detective microphone mounted in the air chamber, the detective microphone detecting sound waves identical to sound waves guided to a rear acoustic terminal of the ribbon microphone unit; and a drive unit for driving the speaker so as to cancel a variation in pressure in the air chamber in response to signals detected by the detective microphone, the variation being caused by sound waves guided to the rear acoustic terminal.

Advantageous Effects of Invention

A variable pressure in the acoustic box is caused by sound waves guided to the rear acoustic terminal of the ribbon microphone unit, and is canceled by the detective microphone, the speaker, and the drive unit. This operation is equivalent to that of the acoustic tube mounted on the rear acoustic terminal of the ribbon microphone unit. According to an aspect of the present invention, the ribbon microphone can have an omnidirectional component without an acoustic tube. The omnidirectional component can be combined with the original bidirectional component of the ribbon microphone to provide unidirectivity. A small high-sensitivity unidirectional ribbon microphone can be achieved since the unidirectivity can be provided without an acoustic tube.

DESCRIPTION OF EMBODIMENT

A ribbon microphone and a unidirectional converter therefor according to an embodiment of the present invention will now be described with reference to the accompanying drawings.

EMBODIMENT

Ribbon Microphone

Figure 1:
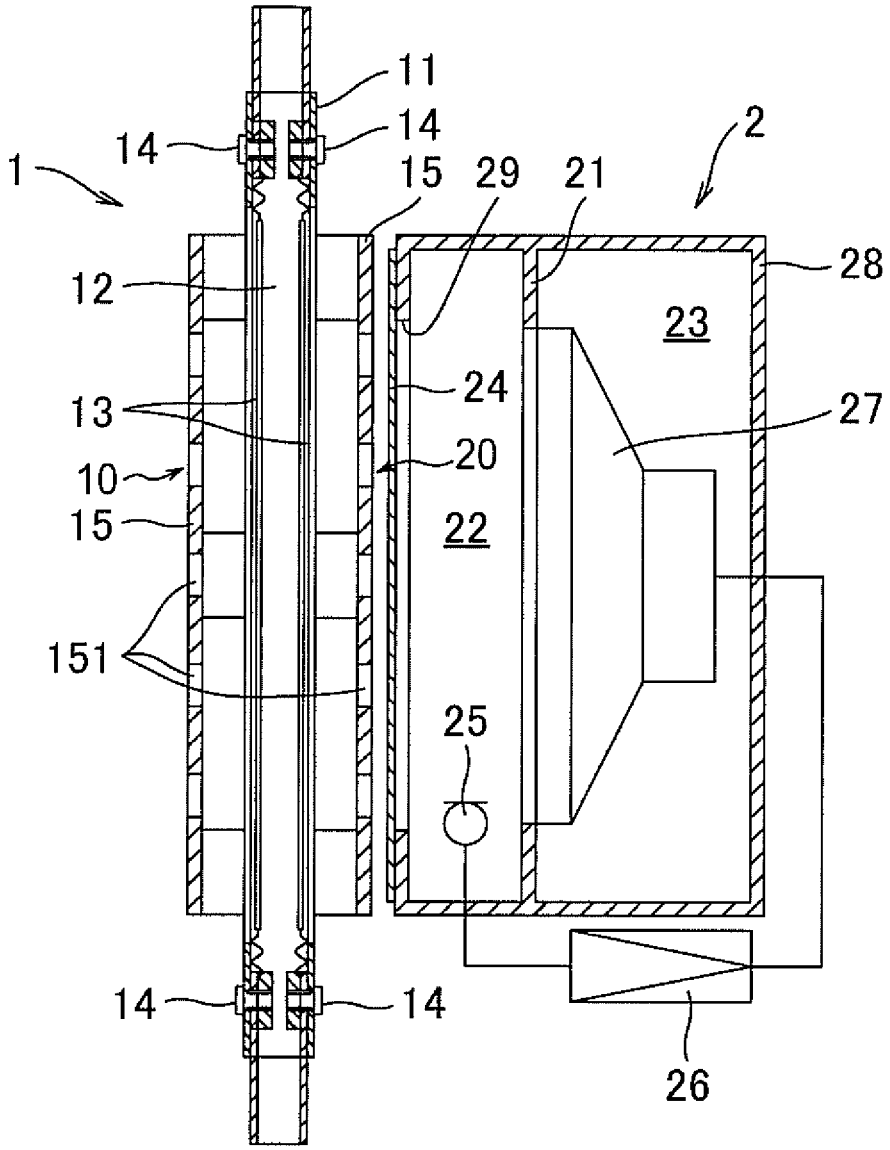
FIG. 1 is a longitudinal cross-sectional view illustrating a ribbon microphone according to an embodiment of the present invention.
Figure 3:
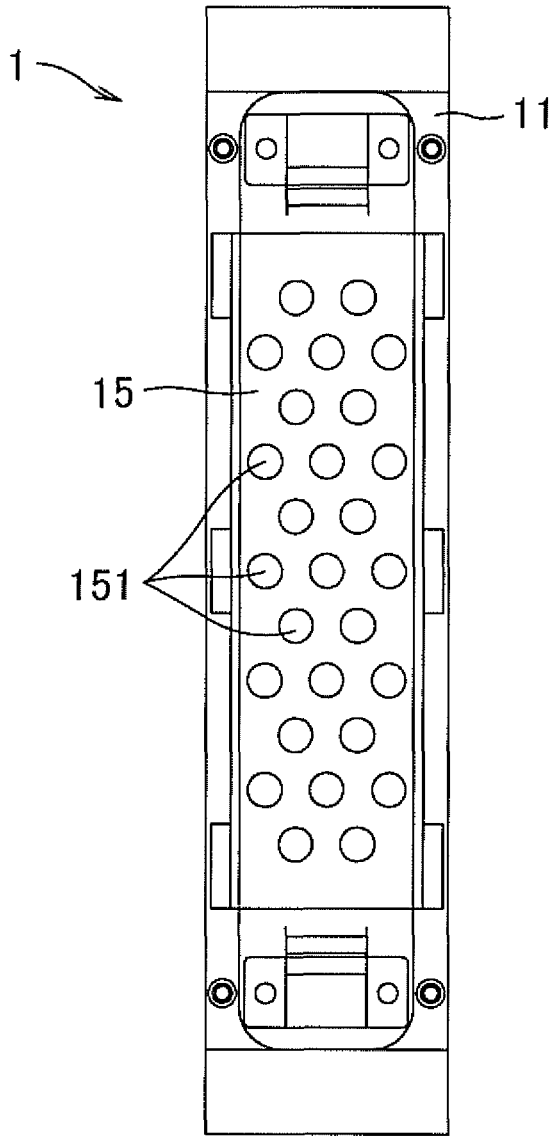
FIG. 3 is a front view illustrating an example ribbon microphone unit applicable to the present invention.

FIG. 1 illustrates a ribbon microphone according to an embodiment of the present invention. The embodiment involves a combination of the unidirectional converter according to an embodiment of the present invention and a ribbon microphone unit. In FIG. 1, a reference numeral 1 represents the ribbon microphone unit. As illustrated also in FIG. 3, a ribbon microphone unit 1 includes a frame 11, magnets 12, ribbon diaphragms 13, output terminals 14, and protective plates 15.

The frame 11 composed of a magnetic material has a rectangular shape (invisible in the drawing). The paired rod magnets 12 having rectangular cross sections are fixed on the respective facing longitudinal inner surfaces of the frame 11. The paired magnets 12 are magnetized in the same width direction and generate a uniform magnetic field between the paired magnets 12. The ribbon diaphragm 13 intersects the magnetic field.

The paired ribbon diaphragms 13 are disposed on the front and rear sides, respectively, of the frame 11. Each ribbon diaphragm 13 having tensile force applied has two longitudinal ends fixed to the respective longitudinal ends of the frame 11. Each ribbon diaphragm 13 is insulated from the frame 11 and is fixed to the frame 11 by appropriate urging force from urging members. The ribbon diaphragms 13 are disposed in the magnetic field and are substantially disposed on the front and rear sides, respectively, of the frame 11. The output terminals 14 are fixed to the respective urging members and output the signals from the ribbon microphone unit 1.

The ribbon diaphragm 13 vibrates in response to sound waves to traverse the magnetic field, and outputs electrical signals, i.e., audio signals in synchronization with the sound waves. The output terminals 14 of the front ribbon diaphragm 13 may be connected to the output terminal 14 of the rear ribbon diaphragm 13 in any appropriate manner, such as a serial or parallel connection. In the example ribbon microphone unit 1 illustrated in FIGS. 1 and 3, protective plates 15 protecting the ribbon diaphragm 13 are attached on the front. and rear sides, respectively, of the unit 1. Each protective plate 15 is composed of a non-magnetic material. Each protective plate 15 in the illustrated embodiment is made of aluminum, which is a light non-magnetic material. Each protective plate 15 is raised from the surface of the frame 11 with multiple spacers to be separated from the ribbon diaphragm 13. Each protective plate 15 is provided with many round holes 151 for guiding sound waves to the ribbon diaphragms 13.

Unidirectional Converter for Ribbon Microphone

Figure 2:
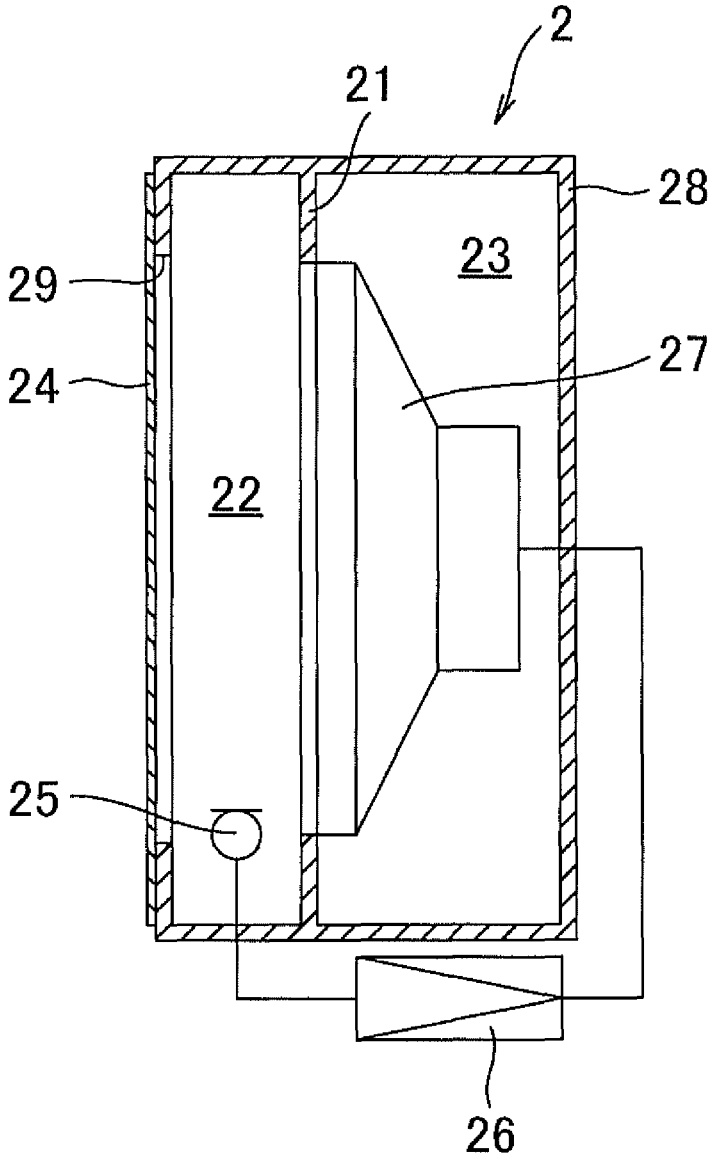
FIG. 2 is a longitudinal cross-sectional view illustrating a unidirectional converter for the ribbon microphone according to an embodiment of the present invention.

The ribbon microphone unit 1 has acoustic terminals 10, 20 on the front and rear sides, respectively, and originally has bidirectivity. One of the front and rear acoustic terminals 10, 20 of the ribbon microphone unit 1 is mounted on a predetermined mounting portion of the unidirectional converter 2. In FIGS. 1 and 2, the unidirectional converter 2 has a rectangular acoustic box 28. The acoustic box 28 has an integrated baffle plate 21 bisecting the internal space into a front space and a rear space. The baffle plate 21 defines a first air chamber 22 on the front side and a second air chamber 23 on the rear side. The baffle plate 21 has a speaker 27 attached thereon in the second air chamber 23. The speaker 27 has a diaphragm facing the first air chamber 22 through a hole provided in the baffle plate 21.

The front wall of the acoustic box 28, i.e., the wall facing the diaphragm of the speaker 27 has a window hole 29 mostly occupying the entire wall. The window hole 29 is covered with a plate acoustic resistor 24. The front surface of the acoustic box 28 including the acoustic resistor 24 and the window hole 29 serves as a ribbon microphone unit attaching portion. One of the front and rear protective plates 15 serving as the front and rear acoustic terminals 10, 20 of the ribbon microphone unit 1 is attached to the attaching portion. Hereinafter, the acoustic terminal mounted on the ribbon microphone unit attaching portion of the acoustic box 28 is referred to as a rear acoustic terminal 20, and the acoustic terminal on the opposite side is referred to as a front acoustic terminal 10. The ribbon microphone unit attaching portion of the acoustic box 28 has a size fittable to the size of the rear acoustic terminal 20, i.e., the protective plate 15 of the ribbon microphone unit 1 to be mounted.

The first air chamber 22 of the acoustic box 28 accommodates a detective microphone 25 detecting sound waves identical to sound waves guided to the rear acoustic terminal 20 of the ribbon microphone unit 1. Audio signals generated by electro-acoustic conversion in the detective microphone 25 are outputted to the input of a drive unit 26 including an amplifier as a main component. The drive unit 26 drives a speaker 27 in response to the signals detected by the detective microphone 25. The drive unit 26 can appropriately adjust a drive level for the speaker 27. The speaker 27 has a cone diaphragm, but may have, for example, a plane or dome diaphragm.

The drive unit 26 drives the speaker 27 so as to reduce the pressure, which is increased by sound waves guided to the rear acoustic terminal 20, in the first air chamber 22 and to boost the pressure, which is decreased by sound waves guided to the rear acoustic terminal 20, in the first air chamber 22. That is, the drive unit 26 drives the speaker 27 so as to cancel a variation in pressure in the first air chamber 22 in response to the signals detected by the detective microphone 25, the variation being caused by sound waves guided to the rear acoustic terminal 20. A control system including the detective microphone 25, the drive unit 26, and the speaker 27 is theoretically equivalent to a feedback active noise canceling apparatus. It should be noted that a feedforward noise canceling apparatus may be unsuitable for the system.

Figure 4:
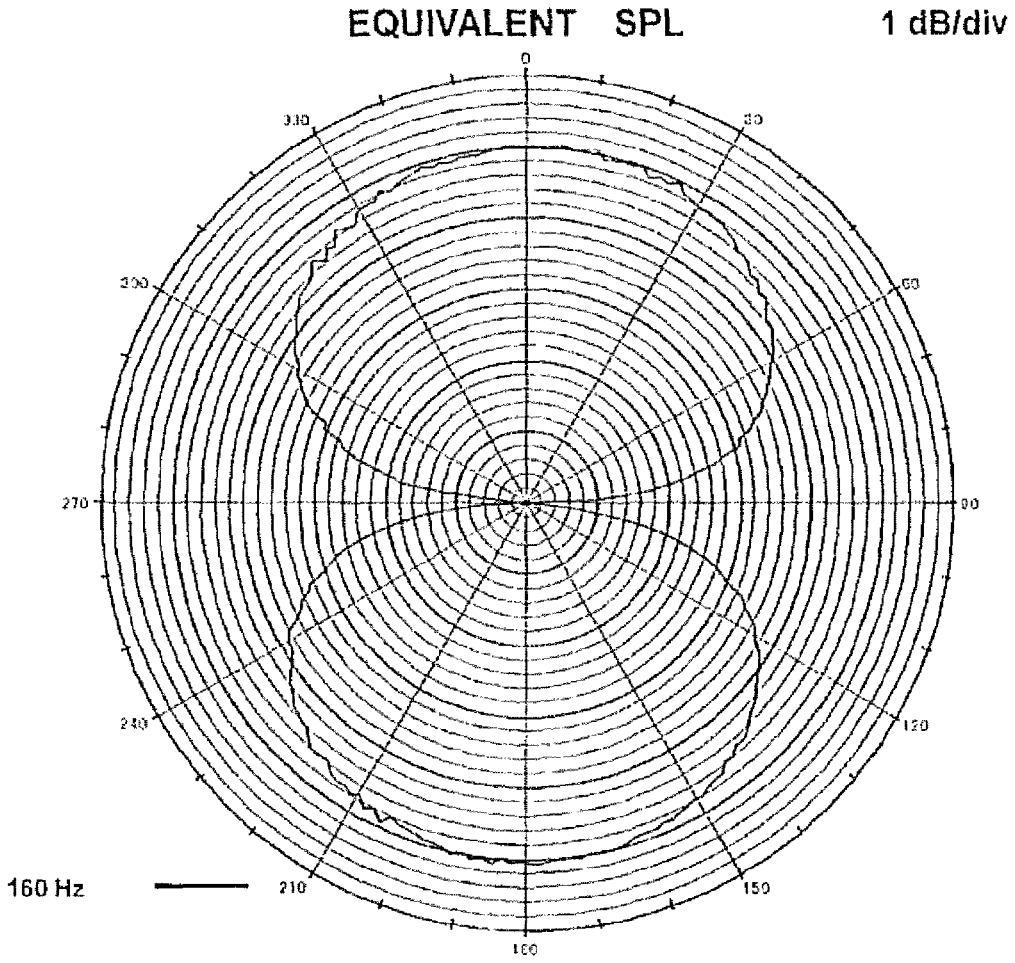
FIG. 4 is a graph illustrating the directional characteristics of the ribbon microphone adjusted to bidirectivity according to the embodiment of the present invention.
Figure 5:
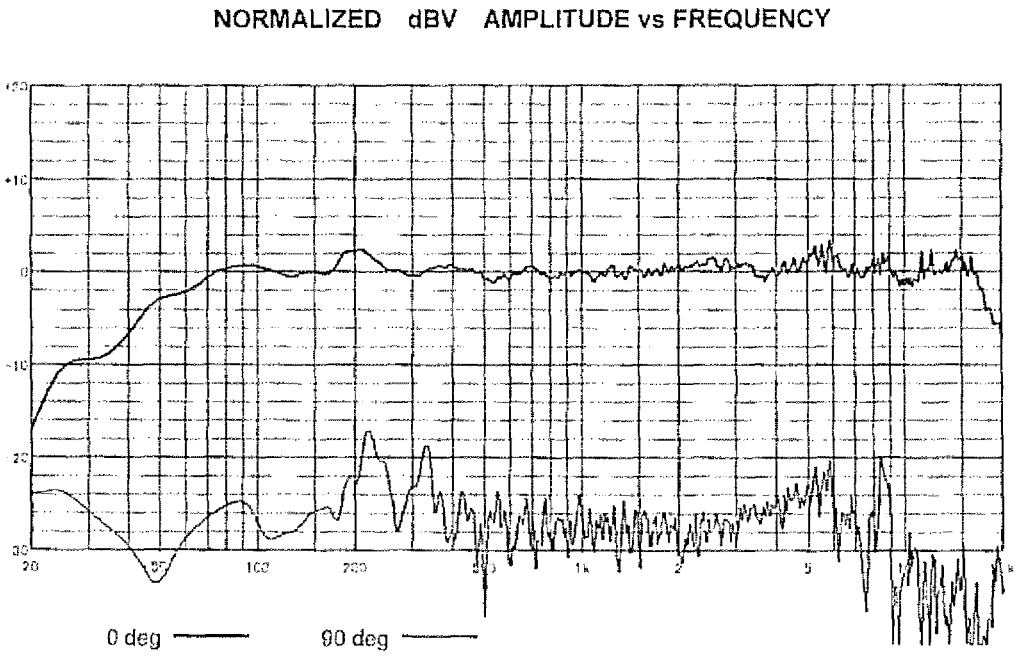
FIG. 5 is a graph illustrating frequency response characteristics of the ribbon microphone adjusted to bidirectivity according to the embodiment of the present invention.

In an assumption of disregarding the signals detected by the detective microphone 25 and no cancellation for a variation in pressure in the acoustic box 28, the variation being generated by sound waves guided to the rear acoustic terminal 20, the ribbon microphone has bidirectivity as illustrated in FIG. 4. This case involves frequency response characteristics illustrated in FIG. 5 and the same characteristics as those of a bare ribbon microphone.

Figure 6:
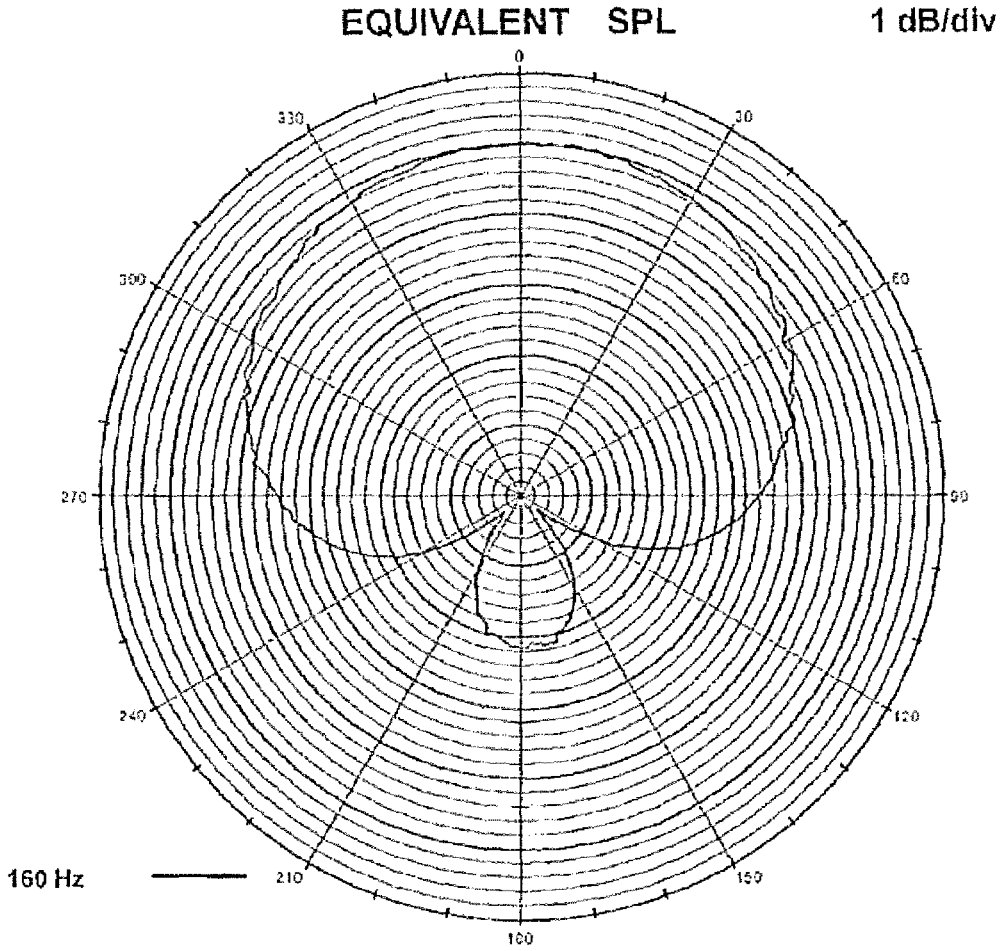
FIG. 6 is a graph illustrating the directional characteristics of the ribbon microphone adjusted to unidirectivity according to the embodiment of the present invention.
Figure 7:
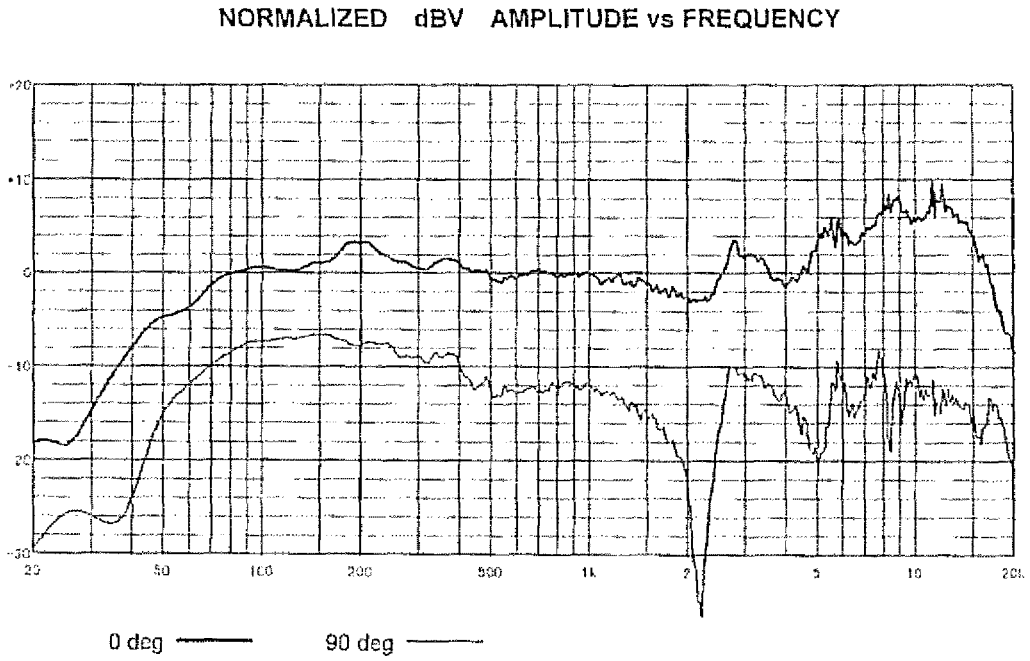
FIG. 7 is a graph illustrating frequency response characteristics of the ribbon microphone adjusted to unidirectivity according to the embodiment of the present invention.

FIG. 6 illustrates directional characteristics provided by maximizing the effect from the unidirectional converter 2. The unidirectional converter 2 is theoretically equivalent to a feedback active noise canceling apparatus as described above. Since the unidirectional converter 2 operates as acoustic capacitance of a large air chamber, an omnidirectional component can be applied to the rear acoustic terminal 20 of the ribbon microphone. The omnidirectional component is applied to the rear acoustic terminal 20 of the ribbon microphone through the acoustic resistance of the acoustic resistor 24. The directivity of the ribbon microphone is converted into unidirectivity as illustrated in FIG. 6 due to the omnidirectional component and the original bidirectivity of the ribbon microphone. This case involves frequency response characteristics illustrated in FIG. 7.

Whether the ribbon microphone has bidirectivity as illustrated in FIG. 4 or unidirectivity as illustrated in FIG. 6 depends on the drive level for the speaker 27 provided by the drive unit 26. The directivity of the ribbon microphone is appropriately adjustable from bidirectivity to unidirectivity through continuous or stepwise adjustment of the drive level for the speaker 27 provided by the drive unit 26.

According to the ribbon microphone and the unidirectional converter in the embodiment of the present invention, the ribbon microphone can have an omnidirectional component without an acoustic tube essential for conventional art. The omnidirectional component can be combined with the original bidirectivity of the ribbon microphone to provide unidirectivity. A small high-sensitivity unidirectional ribbon microphone is achieved since the unidirectivity can be acquired without an acoustic tube.

What is claimed is:

1. A ribbon microphone comprising:

a ribbon microphone unit;

an acoustic box for mounting a rear acoustic terminal of the ribbon microphone unit;

a detective microphone mounted in the acoustic box, the detective microphone detecting sound waves identical to sound waves guided to the rear acoustic terminal of the ribbon microphone unit;

a speaker comprising a diaphragm, the speaker being assembled in the acoustic box and varying the pressure in the acoustic box in response to the driven diaphragm; and a drive unit for driving the speaker so as to cancel a variation in pressure in the acoustic box in response to signals detected by the detective microphone, the variation being caused by sound waves guided to the rear acoustic terminal.

2. The ribbon microphone according to claim 1, wherein the ribbon microphone unit includes a frame for supporting magnets and ribbon diaphragms.

3. The ribbon microphone according to claim 2, wherein the ribbon diaphragms are provided on the front and rear sides, respectively, of the frame, one of the ribbon diaphragms as the rear acoustic terminal being mounted on the acoustic box.

4. The ribbon microphone according to claim 1, wherein the drive unit adjusts directivity of the ribbon microphone through adjustment of a level canceling a variation in pressure in the acoustic box.

5. A unidirectional converter for a ribbon microphone, the unidirectional converter comprising:

an acoustic box;

a baffle plate provided in the acoustic box;

a speaker mounted on the baffle plate;

a ribbon microphone unit attaching portion provided in the acoustic box;

an air chamber defined between the ribbon microphone unit attaching portion in the acoustic box and the baffle plate;

a detective microphone mounted in the air chamber, the detective microphone detecting sound waves identical to sound waves guided to a rear acoustic terminal of the ribbon microphone unit; and a drive unit for driving the speaker so as to cancel a variation in pressure in the air chamber in response to signals detected by the detective microphone, the variation being caused by sound waves guided to the rear acoustic terminal.

6. The unidirectional converter for the ribbon microphone according to claim 5, wherein the ribbon microphone unit attaching portion has an acoustic resistor mounted thereon, and the detective microphone detects sound waves passing through the acoustic resistor.

7. The unidirectional converter for the ribbon microphone according to claim 5, wherein the speaker is a dynamic speaker having a cone diaphragm.

8. The unidirectional converter for the ribbon microphone according to claim 5, wherein the drive unit adjusts directivity of the ribbon microphone through adjustment of a level canceling a variation in pressure in the acoustic box.

9. The unidirectional converter for the ribbon microphone according to claim 5, wherein the baffle plate defines the air chamber and a second air chamber in the acoustic box, and the speaker is attached on the baffle plate in the second air chamber, and a diaphragm of the speaker faces the air chamber.

* * * * *